US009184569B2

(12) United States Patent
Ehrhardt et al.

(10) Patent No.: US 9,184,569 B2
(45) Date of Patent: Nov. 10, 2015

(54) SPARK GAP HAVING A PLURALITY OF INDIVIDUAL SPARK GAPS CONNECTED IN SERIES AND PRESENT IN A STACKED ARRANGEMENT

(75) Inventors: Arnd Ehrhardt, Neumarkt (DE); Stefanie Schreiter, Neumarkt (DE); Steffen Beier, legal representative, Neumarkt/Opf. (DE)

(73) Assignee: DEHN + SÖHNE GmbH + Co. KG, Neumarkt/Opf. (DE)

( * ) Notice: Subject to any disclaimer, the term of this patent is extended or adjusted under 35 U.S.C. 154(b) by 288 days.

(21) Appl. No.: 14/001,983

(22) PCT Filed: Mar. 6, 2012

(86) PCT No.: PCT/EP2012/053794

§ 371 (c)(1),
(2), (4) Date: Oct. 31, 2013

(87) PCT Pub. No.: WO2012/126720

PCT Pub. Date: Sep. 27, 2012

(65) Prior Publication Data

US 2014/0132157 A1 May 15, 2014

(30) Foreign Application Priority Data

Mar. 18, 2011 (DE) ..... 10 2011 014 449
May 31, 2011 (DE) ..... 10 2011 102 941

(51) Int. Cl.
*H01J 7/24* (2006.01)
*F02M 57/06* (2006.01)
(Continued)

(52) U.S. Cl.
CPC ... *H01T 1/14* (2013.01); *H01T 4/16* (2013.01)

(58) Field of Classification Search
USPC ..... 315/119–128
See application file for complete search history.

(56) References Cited

U.S. PATENT DOCUMENTS 3,047,769 A * 7/1962 Hicks et al. ..... H01T 1/14 315/36
3,803,524 A * 4/1974 Schmalz ..... H01T 1/15 337/203

(Continued)

FOREIGN PATENT DOCUMENTS

CN 101090197 12/2007 ..... H01T 4/16
DE 20 56 526 5/1972 ..... H01T 1/15

(Continued)

OTHER PUBLICATIONS

The International Search Report (in English) dated May 8, 2012, the Written Opinion of the International Searching Authority (in English), dated Aug. 18, 2013 and the International Report on Patentability (in English) and dated Sep. 24, 2014 issued by the World Intellectual Property Organization (WIPO) for Applicants' corresponding PCT Application No. PCT/EP2012/053794, filed on Mar. 6, 2012.

(Continued)

*Primary Examiner* — Brandon S Cole
(74) *Attorney, Agent, or Firm* — Gerald T. Bodner

(57) ABSTRACT

The invention relates to a spark gap having a plurality of individual spark gaps connected in series and present in a stacked arrangement, spaced apart from each other by insulating spacers (5) and nearly free of secondary current under typical operating conditions, wherein the individual spark gaps comprise electrodes (4) and outer connection electrodes are provided, and further having control elements for influencing the voltage distribution across the stacked arrangement and/or designed as an ignition aid. According to the invention, a mechanically pretensioned insulating element (8) can be inserted or pivoted between two adjacent electrodes (4) of the individual spark gaps, in order to interrupt the main current path of the spark gap in case of fault or overload.

14 Claims, 10 Drawing Sheets

(51) Int. Cl.

| | |
|---|---|
| ***F02P 13/00*** | (2006.01) |
| ***H01T 1/14*** | (2006.01) |
| ***H01T 4/16*** | (2006.01) |

(56) References Cited

U.S. PATENT DOCUMENTS

| | | | | |
|---|---|---|---|---|
| 4,132,915 | A * | 1/1979 | Wilms | H01T 1/14 313/231.11 |
| 2010/0176814 | A1* | 7/2010 | Couture | G01R 31/085 324/521 |
| 2013/0278129 | A1* | 10/2013 | Krauss | H01T 4/16 313/10 |

FOREIGN PATENT DOCUMENTS

| | | | |
|---|---|---|---|
| DE | 3904253 | 2/1990 | H01H 33/76 |
| DE | 297 24 817 | 4/2004 | H01T 4/16 |
| DE | 10 2007 004342 | 6/2008 | H01H 85/44 |
| EP | 1 077 452 | 2/2001 | H01C 7/12 |
| WO | WO 2007/065997 | 6/2007 | H01T 1/14 |

OTHER PUBLICATIONS

An Office Action (in German with full English translation) issued by the Getman Patent Office for Applicants' corresponding German Patent Application Publication No. DE 10 2011 102 941.2, dated Jun. 4, 2014.

* cited by examiner

Fig. 1 – Prior Art

SPARK GAP HAVING A PLURALITY OF INDIVIDUAL SPARK GAPS CONNECTED IN SERIES AND PRESENT IN A STACKED ARRANGEMENT

The invention relates to a spark gap having multiple series-connected individual spark gaps, which are placed in a stacked arrangement and spaced apart from each other by insulating spacers, and being almost follow-current-free under normal operating conditions, wherein the individual spark gaps include electrodes and external connection electrodes are provided, and further having control elements for influencing the voltage distribution over the stacked arrangement and/or designed as an ignition aid, according to the preamble of patent claim 1.

WO 2007/065997 describes a spark gap for the low-voltage sector, where a current bottleneck is integrated in the conductive path which melts in the event of excessive follow currents or pulsed currents. However, the release in this spark gap, which operates according to the horn principle and, technology-related, is associated with a follow current, is not purely thermal. Also, there is no indicator. A defined fail-safe condition is thus not realizable.

CN 101090197 A describes a stacked arrangement of individual electrodes for low-voltage applications, including an electrical indicator and external control, respectively ignition aids, where at least one fuse, also configured as a thermal fuse, is provided in the current path of the control, respectively ignition aid.

In this arrangement the current of the control/ignition aid and the temperature within the area of the control/ignition aid are monitored. However, according to this configuration the thermal coupling to the components concerned is only insufficient so that only a limited assessment of the thermal condition of the spark gap is possible.

Also, temperature fuses are, in general, not configured for a safe disconnection, in particular in a preferred direct voltage application, so that the control/ignition aid and, thus, the surge arrester as a whole cannot be brought into a defined fail-safe condition.

Moreover, the electrical indicator provided there requires its own energy supply, so that the additional components required in this regard affect the function of the control and ignition aid and, in addition, have to be voltage-proof.

Summarizing, it is noted that no means for the direct condition monitoring are known in the low-voltage sector for spark gaps that are based on a stacked arrangement of individual electrodes, which means transfer the spark gap concerned and/or the associated control, respectively ignition aid into a defined fail-open condition.

In the medium-voltage or high-voltage sector devices for stacked arrangements of spark gaps and/or varistors are known, which disconnect the arrester from the power supply system in the event of an overload. Such arresters comprise a pressure- or gas-controlled device which blast off the connection line, thereby realizing a long isolating gap as air gap outside the arrester. Partially, also blasting charges are used directly. Such a device is shown, for instance, in DE 20 56 526.

Spark gaps known in the prior art having a high follow-current quenching capacity and a corresponding follow-current limiting behavior, which are based for instance on the horn or Radax Flow principle, have a sufficiently high current in the event of a defect to be able to release a, commonly externally arranged, overcurrent protector.

Spark gaps which are based on a stacked arrangement of individual electrodes are preferably configured to be free of follow current so that, in this case, even a sufficiently high release current for an external overcurrent protection device only starts to flow when the whole arrester has already been damaged beyond repair or sparked over, resulting in a danger potential for the system components in the vicinity. Hence, for a fault detection and disconnection at an early stage, there is demand for an integrated protection device including an indicator for such spark gaps. In follow-current-free surge arresters thermal or mechanical damages may occur, for instance, due to excessive pulsed currents, excessive power supply system voltages or a combination of same, meaning that there may be a partial impairment of the arrester, e.g. at the control/ignition aid, or damages to the main functional group, which result in a critical condition of the arrester after a single overload and in an excessive aging of the arrester after a multiple overload.

The generic stacked arrangement of individual electrodes with an external potential control and impedances includes isolating gaps whose number is chosen such that up to the permissible maximum operating voltage level the behavior of the spark gap is virtually follow-current-free when it reacts.

For a spark gap of this type it is the object of the invention to propose a device for monitoring the condition, which reacts on a thermal, adiabatic and/or mechanical overload, for instance as a result of excessive pulsed current loads of the spark gap and/or control, respectively ignition aid. In addition to indicating the respective state of the whole arrester either the control, respectively ignition aid and/or the whole surge arrester are transferred into a defined fail-open condition.

Thus, the condition monitoring device to be created has the task of detecting and indicating any malfunction of the arrester, and transferring the control, respectively ignition aid and/or the whole surge arrester, into a safe condition.

The solution to the object of the invention is achieved with the feature combination according to the teaching of patent claim 1. The dependent claims define at least useful embodiments and further developments.

Accordingly, a corresponding current path at the control, respectively ignition aid and/or at, respectively in the spark gap is interrupted as a result of an increased temperature and/or because a current square integral, e.g. a fuse, has been exceeded, and an insulating element is inserted in the main current path. The movement of the insulating element is coupled with a visual display and, if applicable, an acoustic signaling. Preferably, both release options, i.e. thermally and adiabatically, are realized by means of one common component.

Summarizing the above, there is proposed a spark gap having multiple series-connected individual spark gaps, which are placed in a stacked arrangement and spaced apart from each other by insulating spacers, and being almost follow-current-free under normal operating conditions, wherein the individual spark gaps include electrodes and external connection electrodes are provided. Further, control elements for influencing the voltage distribution over the stacked arrangement and/or designed as an ignition aid are provided.

According to the invention the aforementioned mechanically preloaded insulating element is inserted or pivoted between two adjacent electrodes of the individual spark gaps so as to internally interrupt the main current path of the spark gap in the event of a fault or overload.

The insulating element is arrested by at least one blocking element configured as a current and/or thermal bottleneck and released in the event of a fault or overload. In the latter case the blocking element therefore acts as an unblocking or release element.

The blocking element is located in the main current path and is made of an electrically conductive material. The material properties and the geometry of the blocking element allow an adiabatic release via the current square integral and/or a thermal release through a melting temperature of ≤400° C.

The blocking element and/or the insulating element are connected to a fault indicator or can activate such an indicator.

In one embodiment of the invention the blocking element is formed of a series connection of a fuse tape and an amount of solder.

The protection and interruption device described above may be arranged between two electrodes of the spark gap, which are located in the edge region of the stacked arrangement in the proximity of the connection electrodes, so as to interrupt the current connection path to the control elements.

The preloaded insulating element then simultaneously electrically disconnects, directly or indirectly, the current connection path to the control elements in the case of a release and insulates the corresponding electrodes adjacent to the insulating element.

In another embodiment an electric fuse is incorporated in the electric current path to the control, respectively ignition aid, which interrupts the current connection in the event of an electrical overload.

This fuse may be configured as a thermal fuse.

The interruption of the fuse can furthermore be signaled mechanically, visually or in a similar manner.

In one embodiment of the invention an indicating pin fuse is connected to one of the electrodes, where the current for the ignition or for the voltage distribution is carried via this fuse. The connection between the electrode and the fuse is furthermore achieved by a conductive, thermally sensitive substance, in particular a solder.

If the pulsed current is too high, or in the event of overloads or damages to the individual components of the stacked spark gaps, the mechanical condition of the whole assembly may be endangered. The formation of gaps or the displacement of individual components may lead, in each case, to malfunctions and hazards when the overvoltage protection device reacts. If faults of this type cannot be adequately signaled by the temperature rise or energy input caused by pulsed current surges a mechanical monitoring takes place in accordance with the invention. To this end, the whole stacked arrangement is subjected to a spring preload, wherein, when the spring preload decreases, the insulating element interrupts the main current path.

The invention will be explained in more detail below by means of an exemplary embodiment and with the aid of figures.

Figure 3:
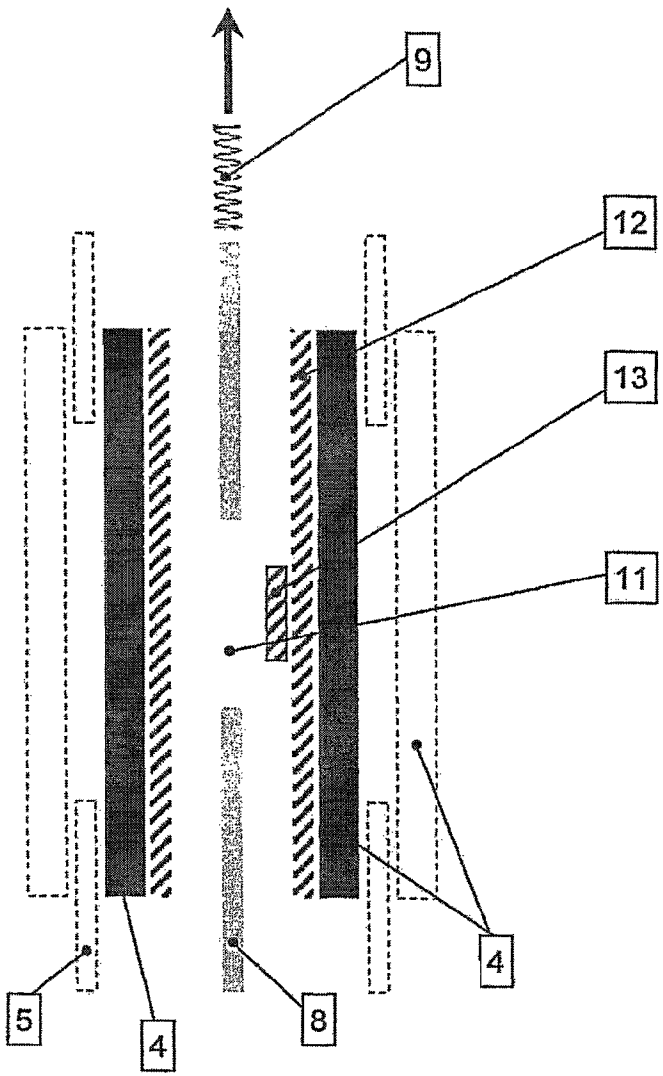
Figure 4:
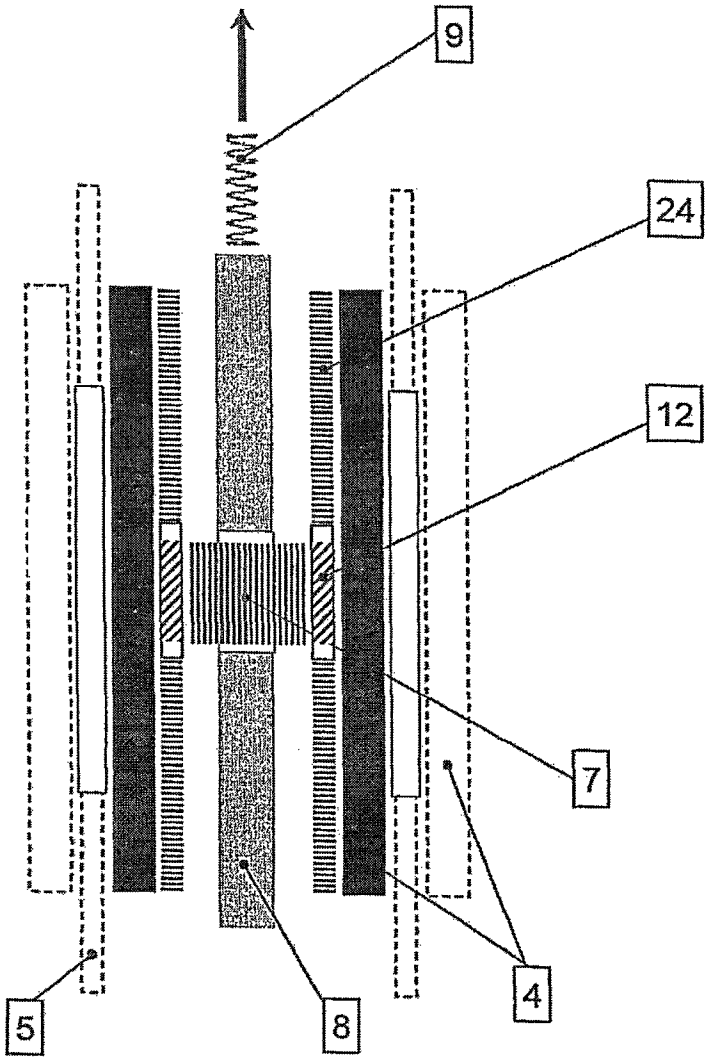
Figure 5A:
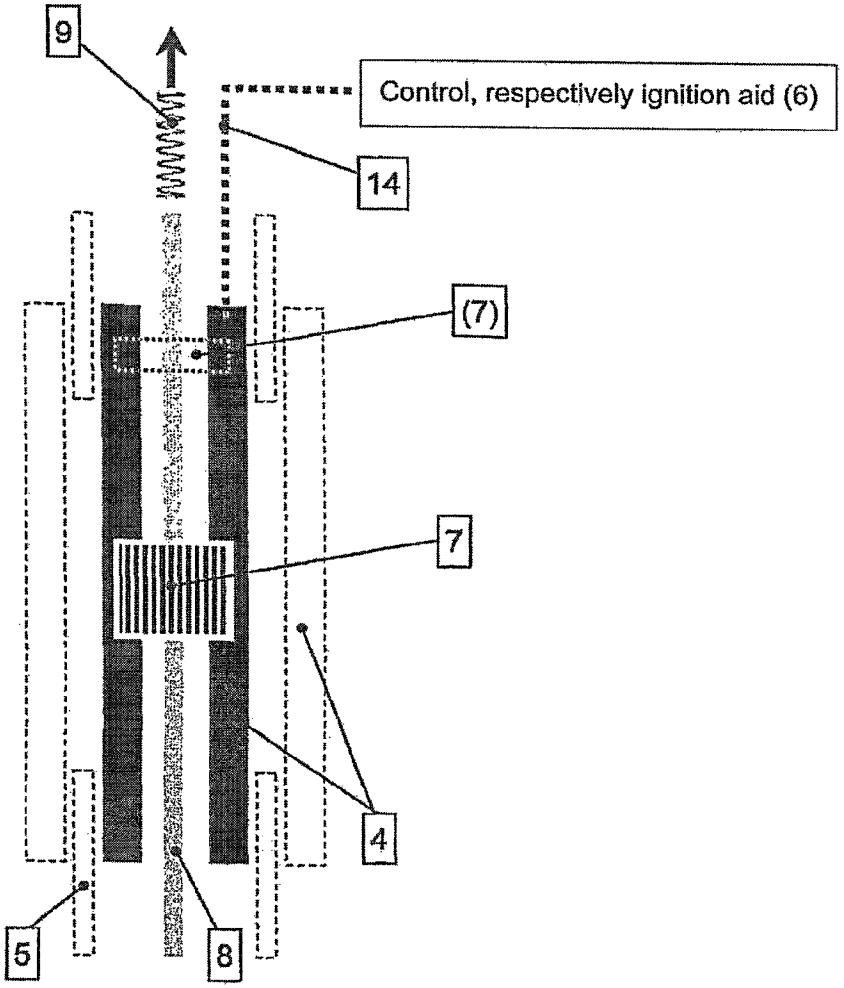
Figure 5B:
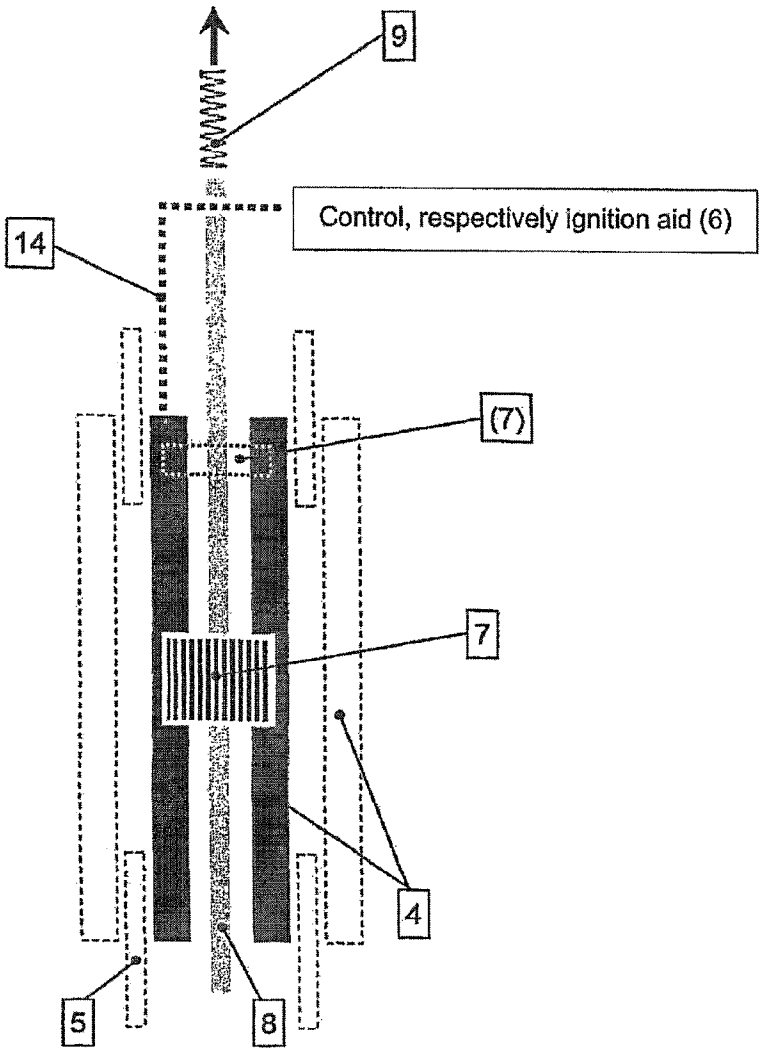
Figure 6:
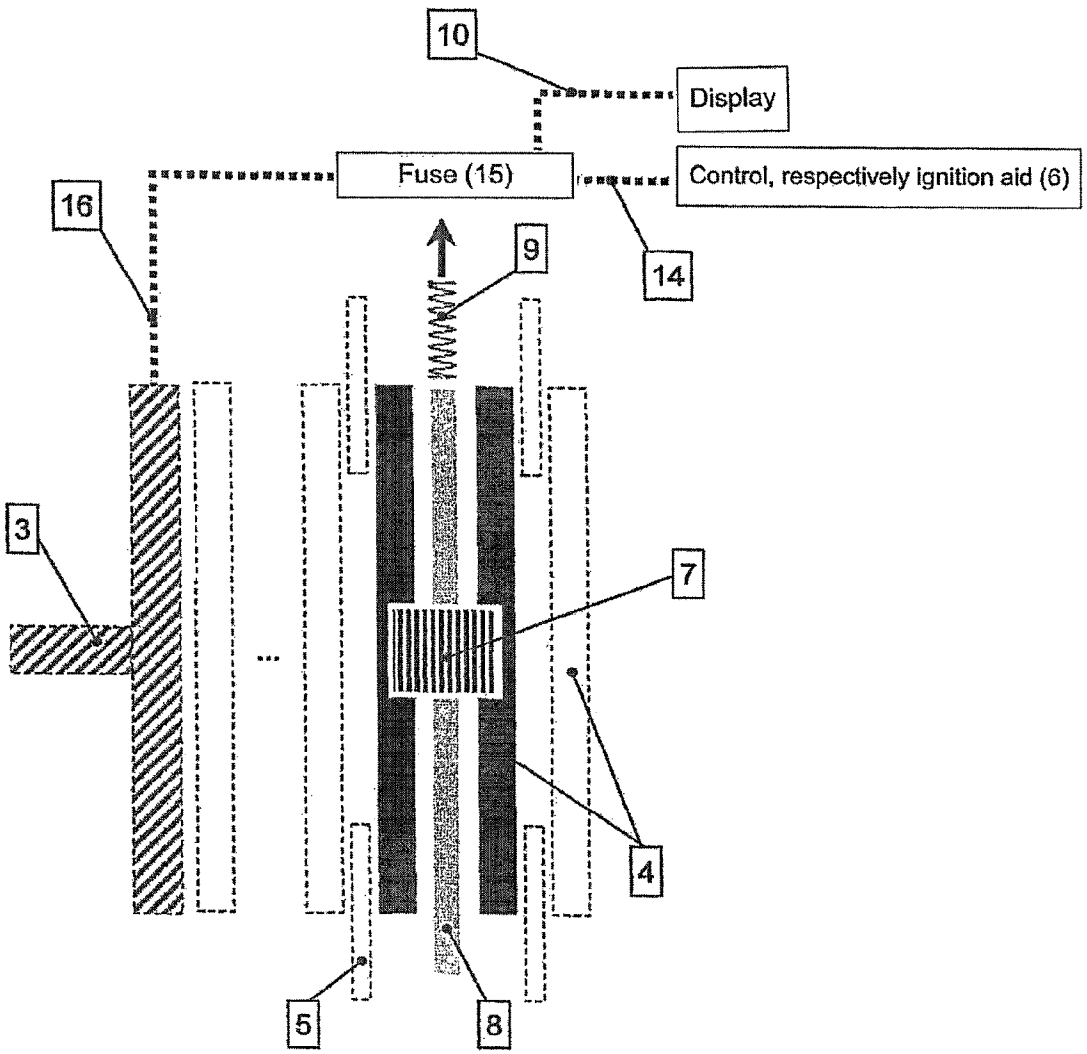
Figure 7:
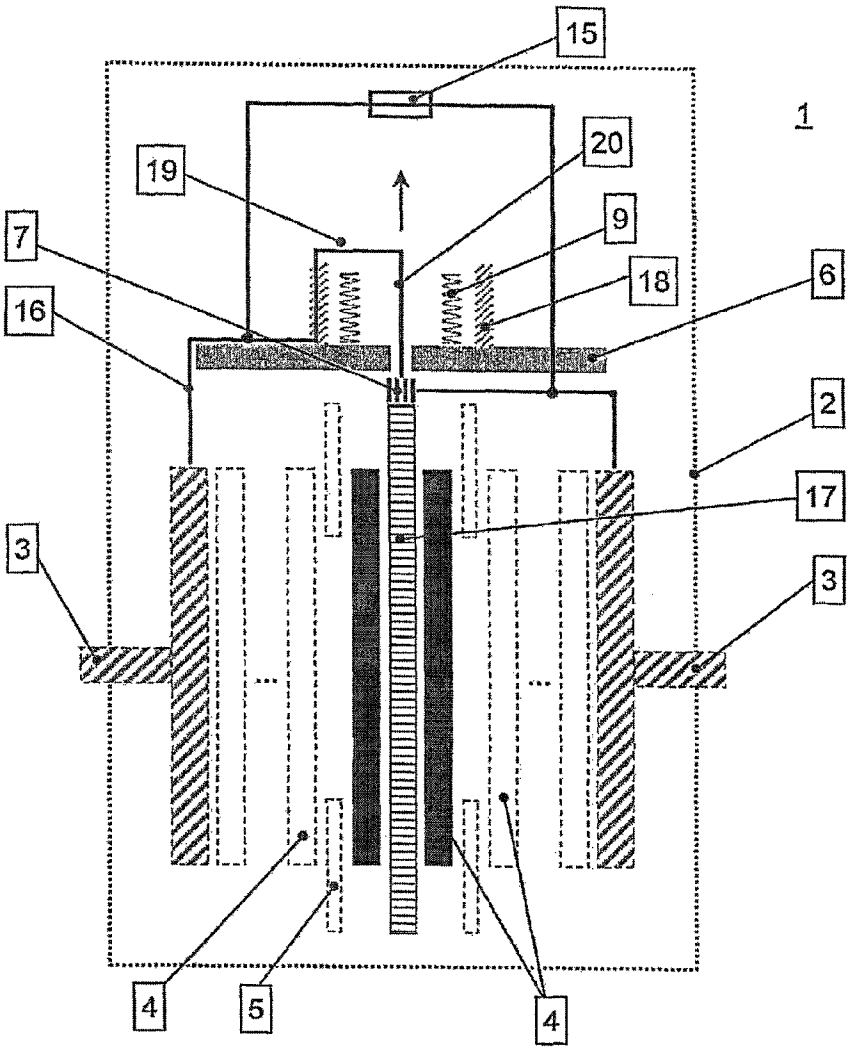
Figure 8:
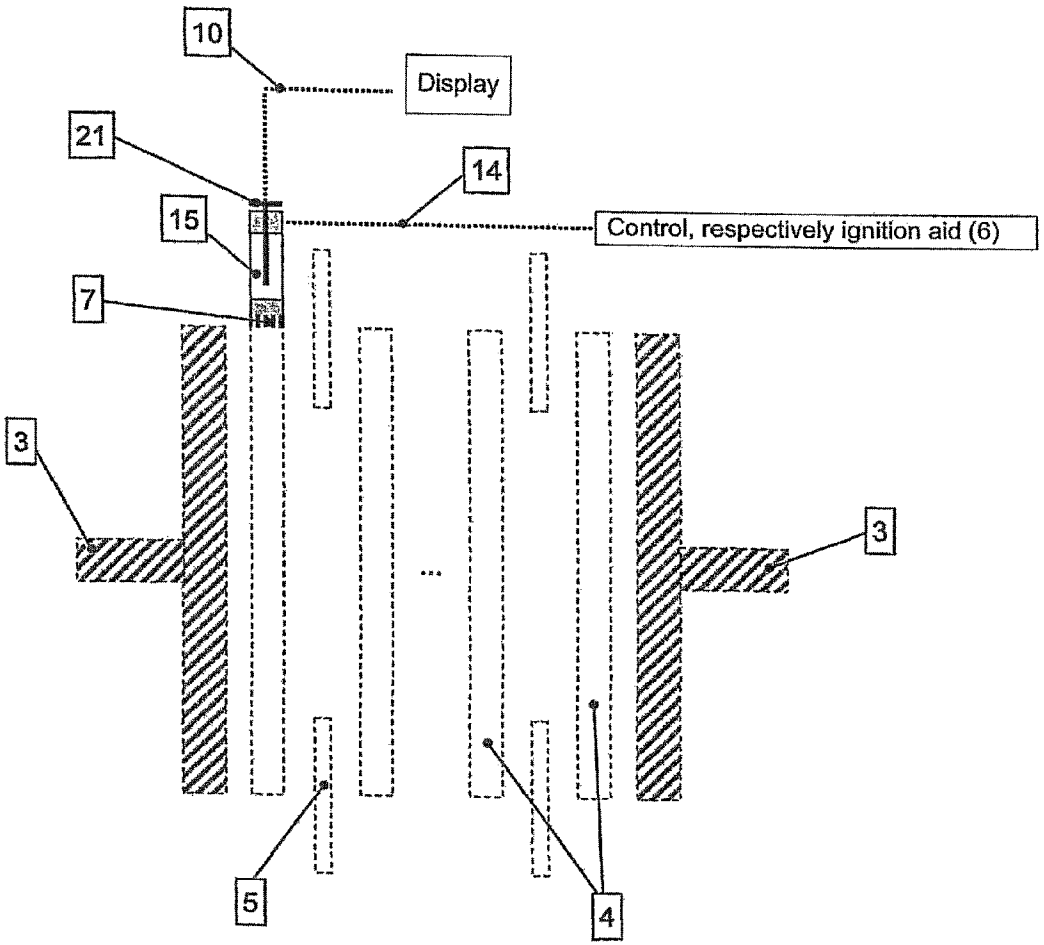
Figure 9:
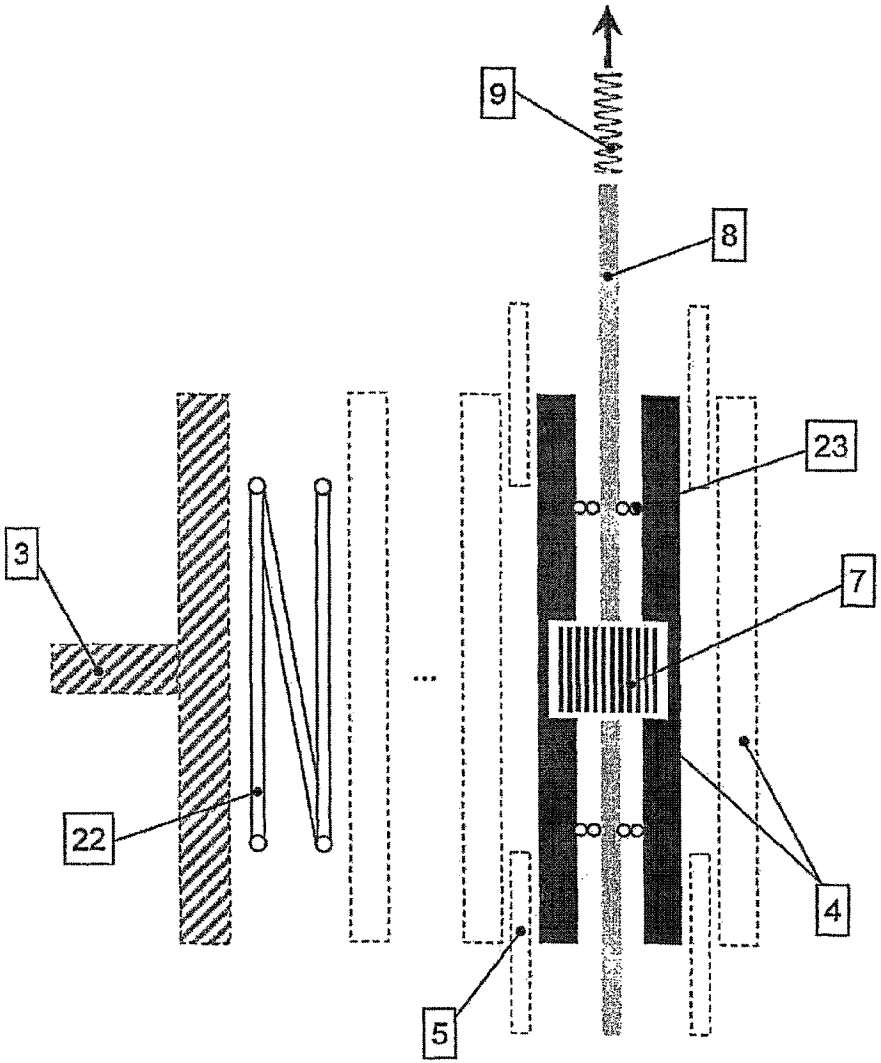

FIG. 3 an embodiment including a current bottleneck as well as a thermal bottleneck which is formed by a solder and placed in series to the former;

FIG. 4 shows an embodiment with a separate signaling function;

FIG. 5*a* shows a first embodiment for monitoring the condition of a control, respectively ignition aid;

FIG. 5*b* shows an embodiment similar to the one of FIG. 5*a*, however with the control, respectively ignition aid being arranged upstream of the insulating element and the current path being interrupted separately, wherein the insulating element may be used for the safe disconnection of both individual components if the current path to the control, respectively ignition aid is passed through the insulating element and is interrupted in the event of a disconnection;

FIG. 6 shows an embodiment with a separate protection device and control, respectively ignition aid, which also exercises a signaling function and, if applicable, also a remote signaling function;

FIG. 7 shows an embodiment including an overcurrent fuse in the current path of the control, respectively ignition aid and a wire-secured release;

FIG. 8 shows an embodiment including a protection device for the control, respectively ignition aid by means of an indicating pin fuse; and FIG. 9 shows an embodiment in a mechanical disconnection device, the whole stacked arrangement being preloaded by a spring.

The aging of surge arresters as a result of multiple overloads in generic spark gaps cannot be precluded when applied in practice and can cause, for instance, too low an insulation resistance. The overload in spark gaps caused by aging is normally overcome by external overcurrent protection devices in the form of conventional switching apparatus, as the demands on previously common disconnections of the arrester from the power supply system are very high due to the intensity of the fault currents to be expected in such spark gaps.

The embodiments show fail-safe protection devices for surge arresters based on spark gaps, integrated in a device and for power supply system applications, in particular in the field of direct voltage applications.

It is pointed out that currently used spark gaps are partially based on very different materials and technologies, so that the electrical aging of the spark gaps, too, varies a lot. This leads, on the other hand, to very different demands on possible protection devices employed to achieve a fail-safe condition, inter alia with respect to the release mechanisms to be applied and the switching capacity.

The following description of the embodiments is limited to spark gaps that do virtually not allow follow currents at a maximum permissible operating voltage, and in particular to those spark gaps that are provided for applications in low-voltage direct current power supply systems.

Figure 1:
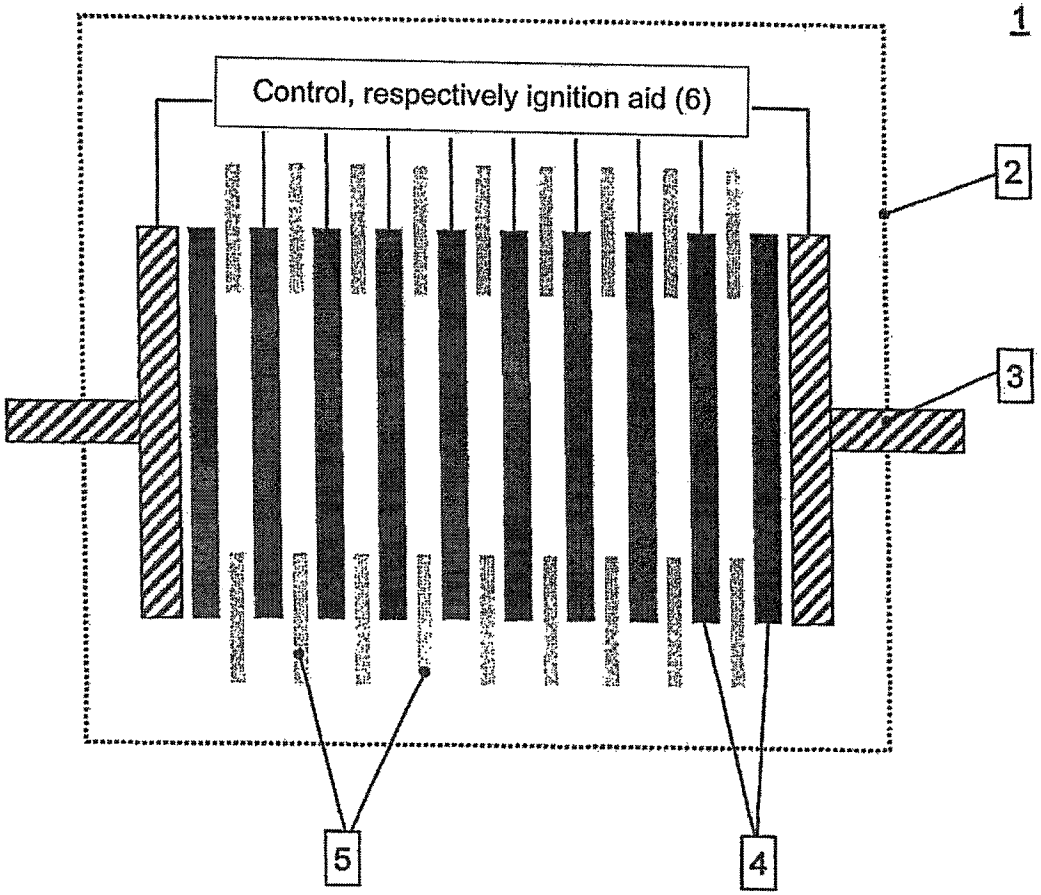
FIG. 1 shows a schematic diagram of a stacked arrangement of individual spark gaps according to the prior art.

The basic structure of an arrester according to the type chosen is based on a stacked arrangement which consists of a sufficient number of individual electrodes, so that preferably a follow-current-free spark gap can be realized. In this respect reference is made to the schematic diagram depicted in FIG. 1.

An arrester 1 of this type comprises at least two connection electrodes, respectively connection terminals 3, a case 2 as well as a device for guiding the stacked arrangement (not shown).

The stacked arrangements are formed of a series connection of disc-shaped individual electrodes 4 and insulating, respectively high-impedance spacers 5.

The volume resistivity of the spacers is at $>10^3$ Ωm. In many cases a control, respectively ignition aid 6, with corresponding discrete components placed in a corresponding configuration, is provided to control the spark-over behavior of the whole spark gap. These components are normally also electrically contacted with several electrodes of the spark gap.

A protection device according to the invention for such a spark gap has to be able to cope with any fault cases resulting from a possible aging, an overload in terms of marked nominal parameters and possible fault conditions of the power supply system.

A gradual aging of the spark gap herein described may ensue from the thermal damaging of the spacers 5, the loss of the insulation capacity of the spacers 5 as a result of impurities, and long-lasting excessive voltages, so that the insulation resistance of the surge arrester is, in this case, insufficient or the surge arrester even represents a low-impedance short circuit and exhibits no more protective function for the system.

Apart from these comparatively slow processes it may, however, also be possible that one or more pulse-like loads outside the marked nominal values of the spark gap result in damaging the overall mechanical arrangement, so that it cannot be precluded after these stresses that the function under normal operating conditions, respectively in another fault case is impaired.

The control, respectively ignition aids 6, which are electrically connected in parallel to the actual spark gap, namely in whole or in part, may likewise be subject to aging because these control, respectively ignition aids 6 are very frequently formed of discrete components which are connected to each other and also to the partial spark gaps of the stacked arrangement. Malfunctions of the spark gap, a loading of the arrangement outside the nominal range, dirt or other reasons for aging may result in the loading of individual components or also of the respective contacts of this control system, as well as in spark-overs along the parallel arrangement to the spark gap. In principle, a protection circuit for this parallel arrangement, too, is thus sensible for protecting an overall arrangement against further damage.

For the protection of the arrester 1 with a stacked arrangement, which is follow-current-free under normal operating conditions, and a control, respectively ignition aid 6 the herein introduced protection device has been created, which protects the surge arrester optimally against an overload and the consequences of aging phenomena, and can be integrated into the arrester in a space-saving fashion.

The protection device described below reacts on thermal and/or adiabatic temperature rises of the spark gap, e.g. caused by exceeding an energy transformation limit value in the event of pulse loads in the spark gap, as well as on various fault conditions of the control, respectively ignition aid. The device allows an indication and/or a remote signaling of the condition of the arrester and transfers the whole arrester 1 or the control, respectively ignition aid 6 into a fail-open state. The respective protection devices for the spark gap and control, respectively ignition aid may be used both individually and in different combinations, depending on the case of application, and are not limited by the exemplary embodiments described below.

Due to the preferred embodiment in the form of a compact device a common indicator and/or remote signaling means is provided both for the spark gap and the control, respectively ignition aid. The signaling may also take place in stages so that, for instance, the system operator is informed whether merely the control, respectively ignition aid is overloaded and was transferred into a corresponding fail-open state, in this case the system has a higher protection level and is in principle still safe, or whether the whole surge arrester is in a fail-open state and the system is not protected and exposed to possible overvoltage events.

The above requires the realization of a fault-dependent fail-open condition of the control, respectively ignition aid or the whole arrester, and also an indicator which becomes active respective the defective component or fault condition.

In addition to the introduced embodiment of a fail-open protection for nearly follow-current-free spark gaps the realization of a fault-dependent fail-open condition and the combination of the protection devices with the indicator is essential.

Figure 2:
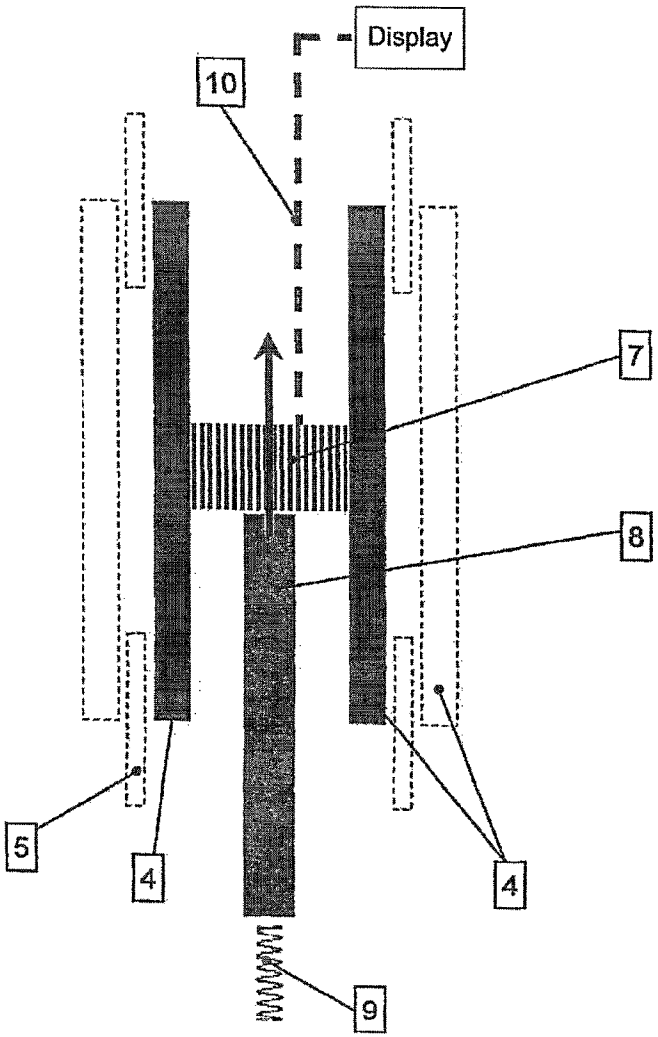
FIG. 2 shows a first embodiment of the protection device realizing the fail-open condition of the stacked arrangement by an insulating element which is capable of interrupting the main current path.

FIG. 2 shows an exemplary embodiment of a protection device for the realization of the fail-open condition of the stacked arrangement.

The active sensitive element 7 of the protection device for the overload risk of the spark gap is directly situated in the main current path and is flown through by the pulsed surge currents and possible leakage currents resulting from aging or occurring under non-acceptable operating conditions, e.g. power frequency overvoltages.

The active sensitive element 7 is arranged such that the heating of the spark gap and the individual electrodes 4 of the spark gap immediately results in the heating of the active element 7. The element, in the claims referred to as blocking element 7, is preferably made of an electrically conductive material with a defined current square integral and/or a melting temperature of ≤400° C.

The current square integral of the blocking element 7 is matched with the respective nominal value, i.e. the maximum permissible pulsed surge current of the spark gap, and can be adapted to the desired nominal values or overload criteria by the cross-sectional surface and the material.

If the blocking element 7 melts as a result of an impermissible temperature and/or current intensity an insulating element 8, designed for instance as a slide or sheet, is moved between the conductive electrodes 4.

The movement of the insulating element 8 can be supported, for instance, by means of a spring 9 and be coupled directly or indirectly with an indicator 10.

The aforementioned movement may be carried out translational, but also rotational, meaning as an insertion or pivoting movement.

By introducing the insulating element 8 into the main current path of the spark gap the spark gap is disconnected from the power supply system, a safe isolating gap is realized and, thus, the whole spark gap is transferred into a fail-open state.

The blocking element 7 may be fixed to the individual electrodes 4 either directly by means of a form-closed connection or by a good electrical and thermally conductive intermediate layer 12 in a two-part electrode or between two individual electrodes, respectively, as is shown in FIG. 3, using an adequate joining technique, e.g. soldering.

The blocking element 7 can basically be positioned at any place, meaning at the front end or the rear end of the stack, or between the individual electrodes of the spark gap.

A central arrangement is thereby a particularly preferred option as the area with the greatest temperature rise may then advantageously be used for the dimensioning of the blocking element 7.

In one embodiment according to the alternative shown in FIG. 3 the current bottleneck 11 is realized, for instance, in the form of a very simple fuse tape and the thermal bottleneck by a solder 13 by means of which the fuse tape is coupled to the individual electrode 4, either directly or indirectly, using a thermally and electrically well conducting intermediate layer 12.

The combination of the fuse tape 11 having a defined melting integral value with the soldering joint 13 which, according to FIG. 3, is temperature-sensitive, exhibits the same range of functions as the blocking element 7 according to FIG. 2, which is configured as a single element, and releases the protection device in the event of an overload as a result of a temperature rise and/or current intensity.

Due to the dimensioning of the stacked arrangement in the form of a follow-current-free configuration the protection device according to the invention does not require any noteworthy switching capacity under operating conditions, as compared to known overcurrent protection devices, so that the construction is very simple and the demands on the material used minimal. This results in a cost-efficient practicability and space-saving accommodation inside the spark gap arrangement.

After the protection device is released, the movement of the insulating element 8 may be directly coupled to an indicating function. However, a separate movement, independent of the indicating function, is possible as well. A separate movement, as shown in FIG. 4, has the advantage that the movement path is shorter so that necessary forces can be minimized.

If a spark gap is transferred into a fail-open state, a control, respectively ignition aid 6, which may be provided, additionally has to be transferable into a safe state, too.

According to FIG. 5*a* one possibility to do so is that, for instance if the blocking element 7 and the insulating element 8 are positioned in the marginal area of the spark gap, the current connection path 14 of the control, respectively ignition aid 6 of the protection device for the spark gap located in the main current path is arranged downstream and is thus automatically disconnected from the power supply system by the isolating gap which is provided upstream in the event of a fault.

It is also possible, however, to realize the power supply of the control, respectively ignition aid 6 by a path which, upon the movement of the insulating element or the indicator coupled therewith, is reliably interrupted. This may be accomplished by means of a splitter, a clip contact or a through-contact. In this respect reference is made to FIG. 5*b*. Such a solution is easy to implement as the current load experienced by the control, respectively ignition aid 6 is only small under normal operating conditions and without electrical indicators, while higher currents can occur only in the event of a fault.

According to the above, when the insulating element 8 is moved, also the path of the control, respectively ignition aid 6 is transferred into a fail-open state in the cases described so as to protect the spark gap. At the same time, an indicator is actuated or a remote signaling is realized, respectively.

If faults occur exclusively in the area of the control, respectively ignition aid 6 and no forced activation of the fail-open condition of the whole overvoltage protection device is to ensue, respectively was not realized, a separately active protection device for the control, respectively ignition aid is sensible, which also fulfills an indicating and, if necessary, remote signaling function.

For the realization of a so further developed embodiment it is proposed in FIG. 6 to incorporate an electric fuse 15 in the electric current path 16 of the control, respectively ignition aid 6, which interrupts the electrical connection in the event of an electrical overload caused by the fault case.

The electric fuse may be configured such that it can also be released purely thermally, e.g. by the choice of the material for the fuse element or a fuse element contact, respectively connection, so that thus a thermal fuse is formed. The interruption of the electrical connection may be passed on to a mechanical indicator 10 by means of an insulating slide or preloaded element. In the simplest case a slide is blocked by the electric fuse element of the fuse under normal operating conditions, and is released in the event of a fault case by the generation of a defined disconnection point.

The indicating of a fault condition of a board for the control, respectively ignition aid can also be realized independently of the function of the insulating element 8, for instance in the form of an indicating pin fuse, a fuse with a striking pin, or also a thermally sensitive contact point. Apart from the mechanical indicators described also electrical indicators are realizable.

In the embodiment according to FIG. 7 a mechanically preloaded release 19 is provided in parallel to an overcurrent fuse 15 for the control, respectively ignition aid 6. For fixing the release 19, for instance, a wire 20 with a low fuse current rating may be used. The wire 20 is placed electrically parallel to the overcurrent fuse and is likewise disconnected when the overcurrent fuse is released.

The exemplary release element 19 is preloaded by a spring 9 and placed in a supporting element 18. The fixing of the wire 20 is accomplished by a temperature-sensitive active element 7. This material is in direct thermal contact with one of the electrodes 4 of the spark gap or, respectively, thermal heat is introduced using a low thermal gradient, e.g. with the aid of a thermally well conducting insulating part 17. An air gap between the two individual electrodes 4 required for this mode of operation, the electrodes 4 enclosing the insulating part 17, is realized by a suited recess in the upper third of the insulating part. The indicating of a fault state of the control, respectively ignition aid 6 is accomplished through the electrical overloading of the fuse 15 and the electrically parallel holding wire 20. In the event of a purely thermal overheating of the stacked arrangement the fixing of the holding wire 20 is thermally released by the excessive temperature at the electrodes 4 of the spark gap 1. The thermally conductive insulating part 17 is then released and used for the realization of an inserted isolating gap. In both cases an indication and/or remote signaling is effected through the coupling with the release 19.

Basically, also an indicating pin fuse or a fuse 15 with an indicating strip 21 can be used, as is shown in FIG. 8.

The signal wire, or also the whole fuse element may, in this design, be fixed inside the fuse by a correspondingly matched temperature-sensitive active element 7. The fuse may be directly fixed to the electrodes 4 by the active element 7, thermally and electrically well conducting or thermally coupled. In a suited embodiment thus the indicating function as well as the electrical contacting 14 of the control, respectively ignition aid 6 can be realized by one single component 15. The indicating, respectively remote signaling function is, in this design, coupled to the indicating strip, respectively indicating pin 21 of the fuse.

The introduced embodiments of the life-time control monitor in particular the effects of overloads on the temperature or the current load in the surge arrester. However, also other physical effects may be used additionally to assess the damage or monitor the fault condition, respectively.

Excessive pulsed current overloads or damages to the individual parts of the stacked spark gaps may endanger the mechanical condition of the whole arrangement. As a result of a gap formation, or by the displacement of individual components, malfunctions and hazards may occur when the overvoltage protection device responds. If such faults cannot be detected to a sufficient extent by the temperature rise or energy input caused by pulsed surge currents, a purely mechanical monitoring may take place.

One possibility in this regard is shown in FIG. 9. Preferably, the whole stacked arrangement is held under a mechanical spring preload by means of spring 22. The contact capable of carrying a pulsed current is realized in a technically known manner by a sliding connection, e.g. the helical spring contact, a flexible connection or a bellows. An additional, or the already present insulating element 8 (see also FIG. 5 in this respect) is mounted between the individual stack parts such that a release is realized once the spring preload of the stack decreases, regardless of the temperature rise, respectively energetic load. The loosening of the stack caused by the pressure load of the spark gap upon pulsed surge currents in the nominal range is below the release limit of this device. The defined release of the arrangement upon the loosening of the stack can be supported by a counterspring 23 in the area of the insulating element, respectively slide 8.

The mechanical damage of the contact arrangement may also lead to the poor contacting of the components of the control, respectively ignition aid 6. In this case there may be a spark formation during the actually normal function of the arrester, which brings about a spark-over hazard for the arrester. In one embodiment this spark formation is monitored by means of a light or radiation sensor. The signal obtained in this embodiment may be used for the directed overcurrent release of the present fuse, by which the control, respectively ignition aid can be transferred into the fail-open condition as outlined. Also, an indication, and optionally a remote signaling, may take place and the thus uncontrolled spark gap remain connected to the power supply system as backup protection with an increased protection level.

The described exemplary embodiments demonstrate how an introduction of the insulating element without a noteworthy intrinsic switching capacity is suited to transfer a follow-current-free spark gap into a defined fail-safe condition, meaning in the event of a thermal, adiabatic and/or mechanical overload hazard. With this design, exclusively the control, respectively ignition aid can be transferred into a fail-open condition, but also the whole surge arrester may be transferred into such a condition. The introduced condition monitoring device has no own energy demand and is thus trouble-resistant. The movement of the insulating element may be coupled to the indicating function, but also be realized independently of same.

LIST OF REFERENCE NUMBERS

1 spark gap
2 case
3 connection electrodes
4 electrodes
5 insulating and high-impedance spacers
6 control, respectively ignition aid
7 active element, respectively blocking element
8 insulating element
9 tension, respectively compression spring
10 current path to the indicator
11 current bottleneck/fuse tape
12 intermediate electrode
13 thermally sensitive connection element
14 current path to the control, respectively ignition aid
15 fuse
16 electrical connection of fuse
17 thermally well conducting insulating element
18 support element
19 movable indicating element release
20 wire
21 indicating pin
22 compression spring
23 counterspring

The invention claimed is:

1. Spark gap having multiple series-connected individual spark gaps, which are placed in a stacked arrangement and spaced apart from each other by insulating or high-impedance spacers, and being almost follow-current-free under normal operating conditions, wherein the individual spark gaps include electrodes and external connection electrodes are provided, and further having control elements for influencing the voltage distribution over the stacked arrangement and/or designed as an ignition aid, characterized in that a mechanically preloaded insulating element can be inserted or pivoted between two adjacent electrodes of the individual spark gaps so as to interrupt the main current path of the spark gap in the event of a fault or overload.

2. Spark gap according to claim 1,
characterized in that
the insulating element is arrested by at least one blocking element configured as a current and/or thermal bottleneck and released in the event of a fault or overload.

3. Spark gap according to claim 2,
characterized in that
the blocking element is located in the main current path, is made of an electrically conductive material capable of carrying a current and has a melting temperature of 400° C.

4. Spark gap according to claim 1,
characterized in that
the blocking element and/or the insulating element is connected to a fault indicator or activates such an indicator.

5. Spark gap according to claim 1,
characterized in that
the blocking element is formed of a series connection of a fuse tape and an amount of solder.

6. Spark gap according to claim 1,
characterized in that
the electrodes are partially provided with an insulating layer.

7. Spark gap according to claim 1,
characterized in that
the preloaded insulating element simultaneously mechanically destroys or disconnects, directly or indirectly, the current connection path to the control elements in the case of a release.

8. Spark gap according to claim 1,
characterized in that
an electric fuse is incorporated in the electric current path to the control, respectively ignition aid itself, which interrupts the current connection in the event of an electrical overload.

9. Spark gap according to claim 8,
characterized in that
the fuse is configured as a thermal fuse.

10. Spark gap according to claim 8,
characterized in that
the interruption of the fuse is signaled mechanically.

11. Spark gap according to claim 1,
characterized in that
an indicating pin fuse is connected to one of the electrodes, wherein the current for the ignition or for the voltage distribution is carried via this fuse, and the connection between the electrode and the fuse is furthermore achieved by a conductive, thermally sensitive substance, in particular a solder.

12. Spark gap according to claim 1,
characterized in that
the whole stacked arrangement is subjected to a spring preload, wherein, when the spring load decreases, the insulating element interrupts the main current path.

13. Spark gap according to claim 1,
characterized in that
the blocking element is arranged by means of an electrical and a thermally conductive intermediate layer in a two-part electrode or between two individual electrodes.

14. Spark gap according to claim 1,
characterized in that
the blocking element is fixed to one of the electrodes in a form-closed manner.

* * * * *